US011428222B2

(12) United States Patent
Ishihara et al.

(10) Patent No.: US 11,428,222 B2
(45) Date of Patent: Aug. 30, 2022

(54) VANE PUMP

(71) Applicant: DENSO CORPORATION, Kariya (JP)

(72) Inventors: Keiichirou Ishihara, Kariya (JP); Tomohiro Itoh, Kariya (JP); Yasuo Katoh, Kariya (JP)

(73) Assignee: DENSO CORPORATION, Kariya (JP)

( * ) Notice: Subject to any disclaimer, the term of this patent is extended or adjusted under 35 U.S.C. 154(b) by 200 days.

(21) Appl. No.: 17/000,549

(22) Filed: Aug. 24, 2020

(65) Prior Publication Data

US 2021/0062810 A1 Mar. 4, 2021

(30) Foreign Application Priority Data

Aug. 29, 2019 (JP) ..... JP2019-156603

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 2/344*** | (2006.01) |
| ***F04C 18/344*** | (2006.01) |

(Continued)

(52) U.S. Cl.

CPC ..... *F04C 2/3441* (2013.01); *F01C 21/0809* (2013.01); *F01C 21/10* (2013.01); *F01C 21/102* (2013.01); *F04C 18/3448* (2013.01); *F04C 29/0078* (2013.01); *F04C 2240/20* (2013.01); *F04C 2240/30* (2013.01)

(58) Field of Classification Search

CPC .... F04C 2/344; F04C 2/3441; F04C 18/3441; F04C 18/3448; F04C 2240/20; F04C 2240/30; F04C 2270/175; F01C 21/10; F01C 21/102; F01C 21/0809; F05C 2225/00; F05C 2251/044; F05C 2253/20

See application file for complete search history.

(56) References Cited

U.S. PATENT DOCUMENTS 3,433,166 A * 3/1969 Birkemeier ..... F01C 21/0809 418/152
4,198,195 A * 4/1980 Sakamaki ..... F01C 21/0809 418/152

(Continued)

FOREIGN PATENT DOCUMENTS

JP 2004211651 A * 7/2004 ..... F04C 2/344
JP 2011122541 A * 6/2011 ..... F04C 2/344

(Continued)

*Primary Examiner* — Theresa Trieu
(74) *Attorney, Agent, or Firm* — Nixon & Vanderhye P.C.

(57) ABSTRACT

A vane pump includes: a casing forming a pump chamber therein; a rotor arranged inside the casing to rotate eccentrically with respect to the casing; and a plurality of vanes configured to rotate with the rotor and slide on an inner side surface of the casing. At least one of Formula (1): $l \leq (b/a) \times k$ and Formula (2): $l \leq (c/a) \times j$ is satisfied, where "a" represents a height of the pump chamber, "b" represents a height of the rotor, "c" represents a height of the vane in a rotation axis direction of the rotor, and where "l" represents a linear expansion coefficient of the casing in the rotation axis direction, "k" represents a linear expansion coefficient of the rotor in the rotation axis direction, and "j" represents a linear expansion coefficient of the vane in the rotation axis direction.

5 Claims, 4 Drawing Sheets

(51) Int. Cl.

| | |
|---|---|
| ***F01C 21/10*** | (2006.01) |
| ***F04C 29/00*** | (2006.01) |
| ***F01C 21/08*** | (2006.01) |

(56) References Cited

U.S. PATENT DOCUMENTS

| | | | | | |
|---|---|---|---|---|---|
| 4,616,984 | A * | 10/1986 | Inagaki | F04C 18/3441 | 418/150 |
| 4,799,867 | A * | 1/1989 | Sakamaki | F01C 21/0809 | 418/152 |
| 5,601,423 | A * | 2/1997 | Meece | F04C 27/005 | 418/133 |
| 2011/0123372 | A1* | 5/2011 | Itoh | F04C 27/005 | 418/133 |
| 2013/0101412 | A1 | 4/2013 | Mitsuhashi et al. | | |
| 2016/0160809 | A1* | 6/2016 | Hasegawa | F04C 27/005 | 418/133 |
| 2016/0201675 | A1 | 7/2016 | Mitsuhashi et al. | | |
| 2017/0284398 | A1 | 10/2017 | Mitsuhashi et al. | | |

FOREIGN PATENT DOCUMENTS

| | | | | | |
|---|---|---|---|---|---|
| JP | 2011-214519 | | 10/2011 | | |
| JP | 2012241172 | A * | 12/2012 | F04C 2/344 | |
| JP | 2014098394 | A * | 5/2014 | F04C 18/3441 | |
| WO | WO-2021024841 | A1 * | 2/2021 | F04C 2/344 | |

* cited by examiner

VANE PUMP

CROSS REFERENCE TO RELATED APPLICATION

This application is based on Japanese Patent Application No. 2019-156603 filed on Aug. 29, 2019, the disclosure of which is incorporated herein by reference in its entirety.

TECHNICAL FIELD

The present disclosure relates to a vane pump.

BACKGROUND

A vane pump includes: a casing that forms a pump chamber; a rotor; and vanes that slide on an inner surface of the casing. The casing, the rotor, and the vanes are made of materials having substantially the same linear expansion coefficients.

SUMMARY

According to an aspect of the present disclosure, a vane pump includes: a casing forming a pump chamber therein; a rotor arranged inside the casing to rotate eccentrically with respect to the casing; and a plurality of vanes configured to rotate with the rotor and slide on an inner side surface of the casing. At least one of Formulas (1) and (2) is satisfied, $$l \leq (b/a) \times k, \quad \text{Formula (1)}$$

$$l \leq (c/a) \times j, \text{ wherein} \quad \text{Formula (2)}$$

"a" represents a height of the pump chamber in a rotation axis direction of the rotor, "b" represents a height of the rotor in the rotation axis direction, "c" represents a height of the vane in the rotation axis direction, "l" represents a linear expansion coefficient of the casing in the rotation axis direction, "k" represents a linear expansion coefficient of the rotor in the rotation axis direction, and "j" represents a linear expansion coefficient of the vane in the rotation axis direction.

According to another aspect of the present disclosure, a vane pump includes: a casing forming a pump chamber therein; a rotor arranged inside the casing to rotate eccentrically with respect to the casing; and a plurality of vanes configured to rotate with the rotor and slide on an inner side surface of the casing. The casing is formed of a plurality of case bodies arranged in a rotation axis direction of the rotor. The plurality of case bodies are fastened and fixed by a fastening member so as to be in a pressure contact with each other in the rotation axis direction. The fastening member is arranged to extend in the rotation axis direction between both end surfaces of the pump chamber in the rotation axis direction. At least one of Formulas (5) and (6) is satisfied, $$m \leq (b/a) \times k, \quad \text{Formula (5)}$$

$$m \leq (c/a) \times j, \text{ wherein} \quad \text{Formula (6)}$$

"a" represents a height of the pump chamber in the rotation axis direction,

"b" represents a height of the rotor in the rotation axis direction,

"c" represents a height of the vane in the rotation axis direction,

"m" represents a linear expansion coefficient of the fastening member in the rotation axis direction, "k" represents a linear expansion coefficient of the rotor in the rotation axis direction, and "j" represents a linear expansion coefficient of the vane in the rotation axis direction.

DETAILED DESCRIPTION

Figure 1:
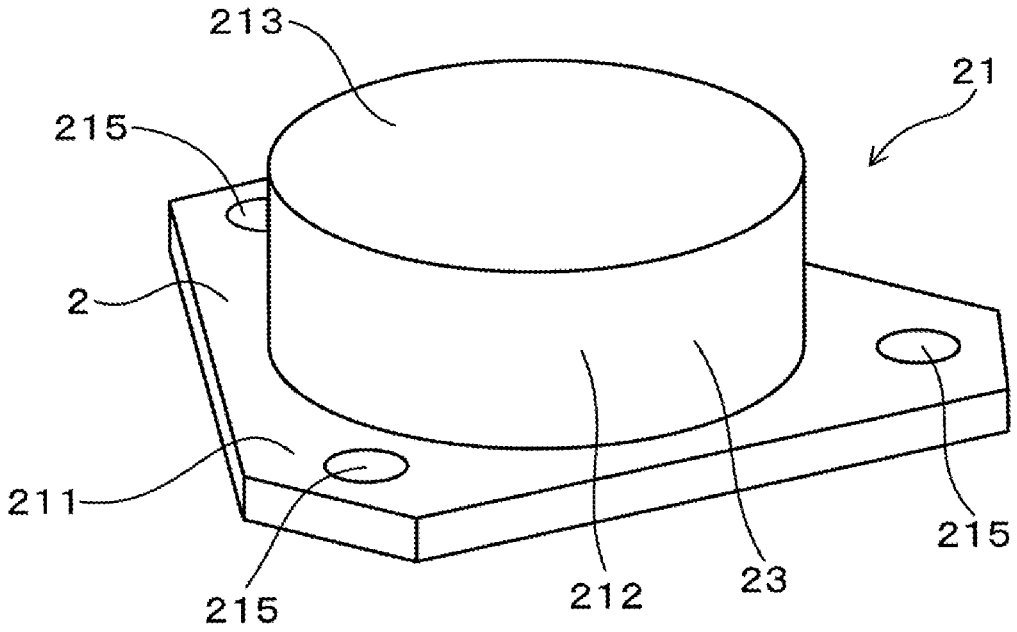
FIG. 1 is a perspective view illustrating a first case body according to a first embodiment.

To begin with, examples of relevant techniques will be described.

A vane pump includes: a casing that forms a pump chamber; a rotor; and vanes that slide on an inner surface of the casing. The casing, the rotor, and the vanes are made of materials having substantially the same linear expansion coefficients. Depending on the application of the vane pump, a fluctuation in the discharge pressure is to be suppressed.

However, in case where the casing, the rotor, and the vanes have substantially the same linear expansion coefficient, if the temperature of the vane pump is raised, a clearance between the casing, and the rotor and the vane in the rotation axis direction of the rotor may increase. Then, there is concern that the discharge pressure may decrease due to the increased clearance. In this case, it is difficult to suppress the fluctuation in the discharge pressure of the vane pump.

The present disclosure provides a vane pump capable of suppressing a decrease in discharge pressure caused by a rise in temperature.

According to an aspect of the present disclosure, a vane pump includes: a casing forming a pump chamber therein; a rotor arranged inside the casing to rotate eccentrically with respect to the casing; and a plurality of vanes configured to rotate with the rotor and slide on an inner side surface of the casing. At least one of Formulas (1) and (2) is satisfied, $$l \leq (b/a) \times k, \quad \text{Formula (1)}$$

$$l \leq (c/a) \times j, \quad \text{Formula (2)}$$

wherein "a" represents a height of the pump chamber in a rotation axis direction of the rotor, wherein "b" represents a height of the rotor in the rotation axis direction, wherein "c" represents a height of the vane in the rotation axis direction, wherein "l" represents a linear expansion coefficient of the casing in the rotation axis direction, wherein "k" represents a linear expansion coefficient of the rotor in the rotation axis direction, and wherein "j" represents a linear expansion coefficient of the vane in the rotation axis direction.

According to another aspect of the present disclosure, a vane pump includes: a casing forming a pump chamber therein; a rotor arranged inside the casing to rotate eccentrically with respect to the casing; and a plurality of vanes configured to rotate with the rotor and slide on an inner side surface of the casing. The casing is formed of a plurality of case bodies arranged in a rotation axis direction of the rotor. The plurality of case bodies are fastened and fixed by a fastening member so as to be in a pressure contact with each other in the rotation axis direction. The fastening member is arranged to extend in the rotation axis direction between both end surfaces of the pump chamber in the rotation axis direction. At least one of Formulas (5) and (6) is satisfied, $$m \leq (b/a) \times k, \quad \text{Formula (5)}$$

$$m \leq (c/a) \times j, \quad \text{Formula (6)}$$

wherein "a" represents a height of the pump chamber in the rotation axis direction, wherein "b" represents a height of the rotor in the rotation axis direction, wherein "c" represents a height of the vane in the rotation axis direction, wherein "m" represents a linear expansion coefficient of the fastening member in the rotation axis direction, wherein "k" represents a linear expansion coefficient of the rotor in the rotation axis direction, and wherein "j" represents a linear expansion coefficient of the vane in the rotation axis direction.

The vane pump according to the one aspect satisfies at least one of Formula: $l \leq (b/a) \times k$ and Formula: $l \leq (c/a) \times j$. Therefore, when the temperature of the vane pump rises, it is possible to suppress increase in the clearance between the casing, and the rotor and the vane in the rotation axis direction of the rotor. As a result, it is possible to restrict the discharge pressure from decreasing while the temperature rises.

The vane pump according to the another aspect satisfies at least one of Formula: $m \leq (b/a) \times k$ and Formula: $m \leq (c/a) \times j$. Therefore, when the temperature of the vane pump rises, it is possible to suppress increase in the clearance between the casing, and the rotor and the vane in the rotation axis direction of the rotor. As a result, it is possible to restrict the discharge pressure from decreasing while the temperature rises.

Accordingly, it is possible to provide the vane pump that can suppress decrease in the discharge pressure while the temperature rises.

First Embodiment

Figure 2:
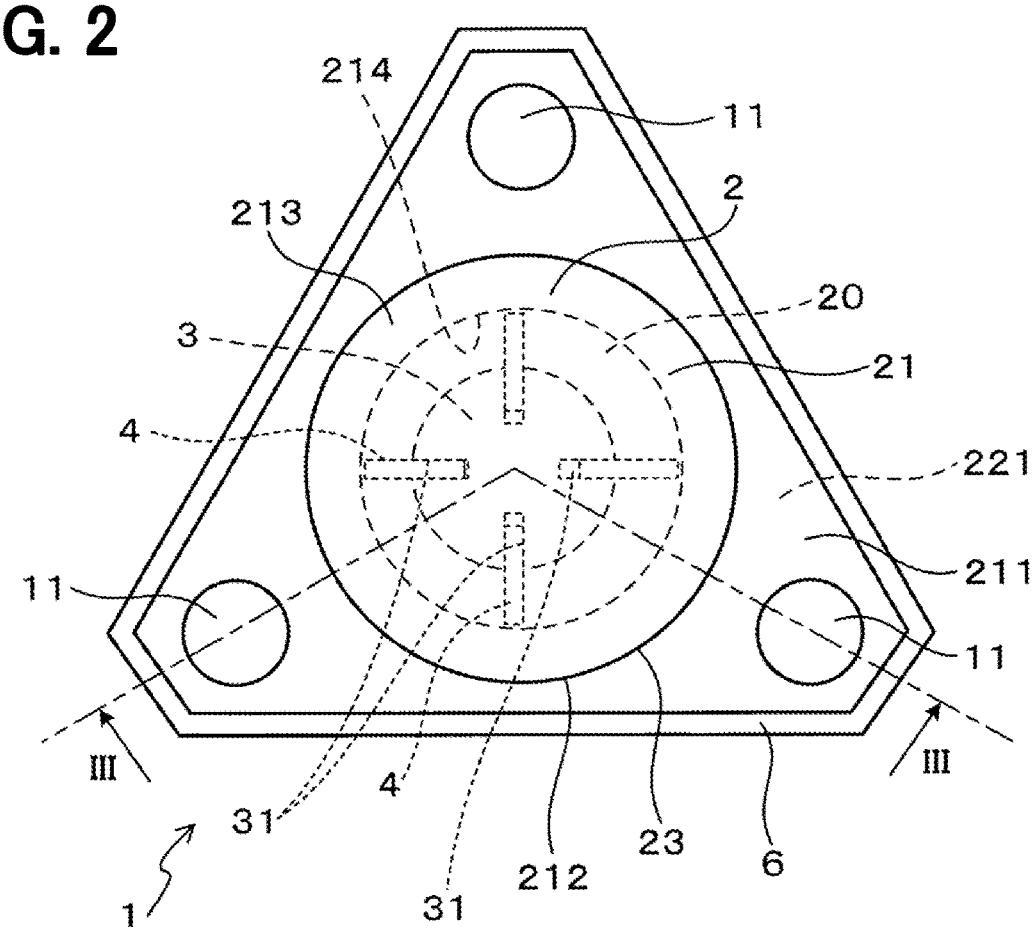
FIG. 2 is a plan view illustrating a vane pump according to the first embodiment.
Figure 3:
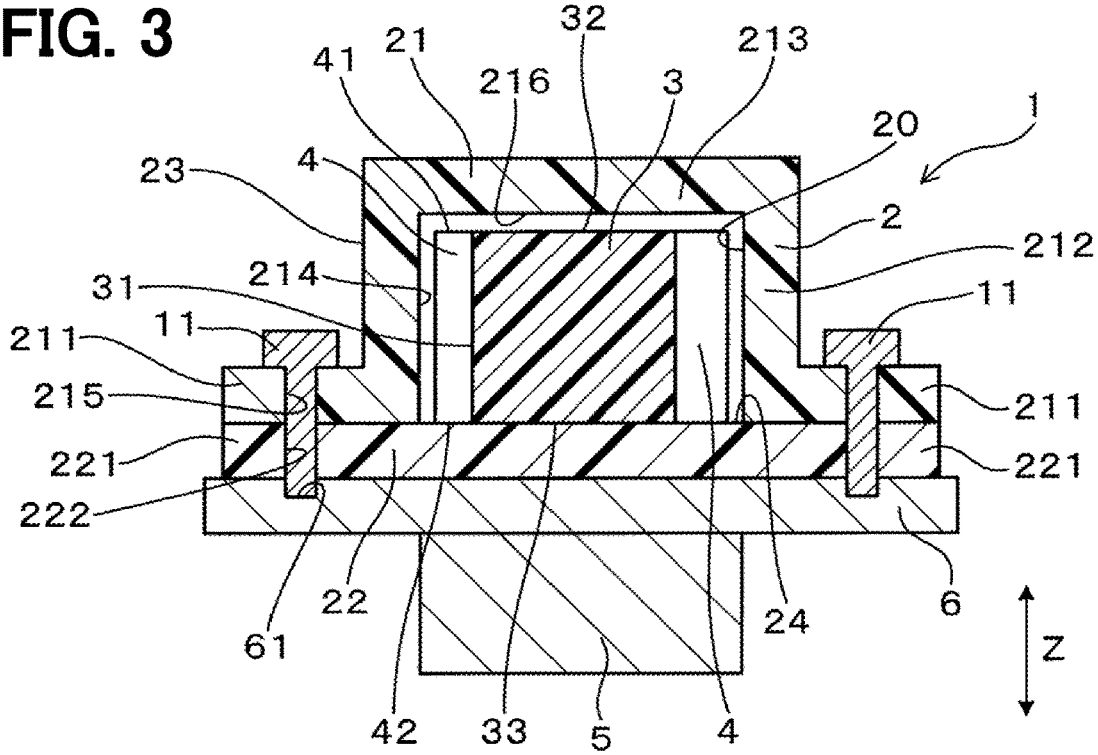
FIG. 3 is a cross-sectional view taken along a line III-III of FIG. 2.

A vane pump according to a first embodiment will be described with reference to FIGS. 1 to 5. As shown in FIG. 3, a vane pump 1 of the present embodiment includes a casing 2, a rotor 3, and plural vanes 4. The casing 2 forms a pump chamber 20 inside. The rotor 3 is arranged inside the casing 2. The rotor 3 rotates eccentrically with respect to the casing 2, as shown in FIG. 2. The vane 4 rotates together with the rotor 3. Further, the vane 4 slides on the inner side surface 214 of the casing 2.

Figure 4:
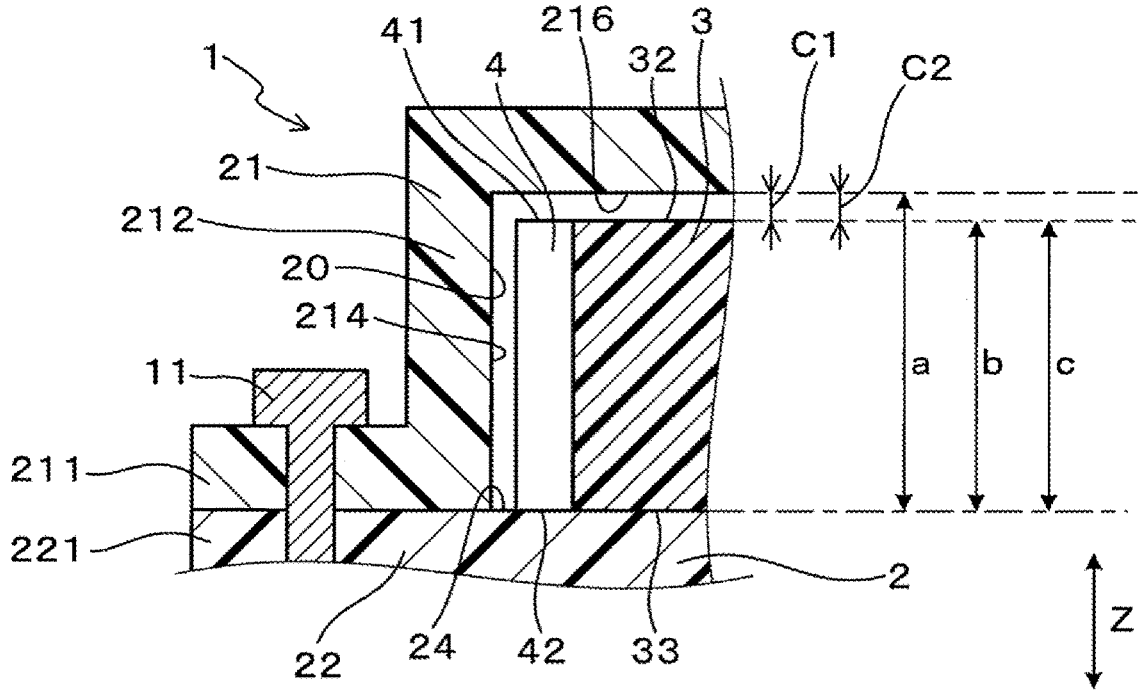
FIG. 4 is a cross-sectional view of the vane pump of the first embodiment at a reference temperature.

As shown in FIG. 4, the height of the pump chamber 20 in the rotation axis direction Z of the rotor 3 is defined as "a", the height of the rotor 3 in the rotation axis direction Z is defined as "b", and the height of the vane 4 in the rotation axis direction Z is defined as "c". Further, the linear expansion coefficient of the casing 2 in the rotation axis direction Z is defined as "l", the linear expansion coefficient of the rotor 3 in the rotation axis direction Z is defined as "k", and the linear expansion coefficient of the vane 4 in the rotation axis direction Z is defined as "j". In this case, at least one of Formulas (1) and (2) is satisfied.

$$l \leq (b/a) \times k, \quad \text{Formula (1)}$$

$$l \leq (c/a) \times j, \quad \text{Formula (2)}$$

Further, in the present embodiment, the linear expansion coefficients l, k, j are values larger than 0. The rotation axis direction Z of the rotor 3 is also appropriately referred to as the Z direction.

In the present embodiment, both Formula (1) and Formula (2) are satisfied. In the present embodiment, the rotor 3 and the vanes 4 are made of the same material. Therefore, the linear expansion coefficient k of the rotor 3 and the linear expansion coefficient j of the vane 4 are the same.

The casing 2, the rotor 3, and the vane 4 are made of resin. Specifically, for example, the rotor 3 and the vane 4 are made of phenol resin, and the casing 2 is made of polyphenylene sulfide (PPS) resin.

The rotor 3 is rotated by the motor 5. As shown in FIG. 3, the motor 5 is fixed to the fixed member 6 by a fastening member (not shown), and the casing 2 is fixed by the fastening member 11. In the present embodiment, the fastening member 11 is a screw. The screw is made of, for example, an iron alloy.

The motor 5 is arranged on one side of the casing 2 in the Z direction. The fixed member 6 is interposed between the motor 5 and the casing 2 in the Z direction. In other words, the casing 2 is arranged on the upper side of the fixed member 6 in the Z direction, and the opposite side of the upper side is referred as the lower side.

The vane pump 1 is controlled to rotate at a constant speed so that the rotation speed of the rotor 3 is constant. That is, the motor 5 that rotates the rotor 3 is subjected to a constant rotation control.

Even if the drive power is constant, the vane pump 1 may vary in rotation speed due to various factors such as variation in frictional resistance. However, depending on the application of the vane pump 1, it may be necessary to restrict the rotation speed from fluctuating. Therefore, in such a case, the constant rotation control is performed to control the rotation speed to be constant.

The vane pump 1 of the present embodiment is used, for example, in an evaporated fuel processing device including a leakage diagnosis unit for evaporated fuel. For example, the vane pump 1 is used as a decompression pump that decompresses the inside of diagnosis target system including a canister. The leak diagnosis unit is configured to perform a leak diagnosis of the diagnosis target system based on a pressure change when the inside of diagnosis target system is decompressed by the vane pump 1.

As shown in FIG. 3, the casing 2 has a first case body 21 and a second case body 22. The first case body 21 and the second case body 22 are fixed to each other in the Z direction. As shown in FIGS. 1 and 3, the first case body 21 has a first flange 211. The first flange 211 projects outward from the outer side surface 23 of the casing 2. The second case body 22 has a second flange 221 as shown in FIG. 3. The second flange 221 projects outward from the outer side surface 23 of the casing 2.

The second flange 221 is arranged below the first flange 211. The first case body 21 and the second case body 22 are fixed to each other. The first flange 211 and the second flange 221 are fixed to the fixed member 6 by the fastening member 11. As shown in FIG. 3, the fastening member 11 is inserted into an insertion hole 215 of the first flange 211 and an insertion hole 222 of the second flange 221, and is engaged with a female thread 61 of the fixed member 6.

The second case body 22 has a substantially flat plate shape. As shown in FIGS. 1 and 3, the first case body 21 has an outer peripheral wall 212 and a top plate 213. The outer peripheral wall 212 has a substantially cylindrical shape. The top plate 213 has a substantially circular flat plate shape and is extended to be orthogonal to the Z direction. The top plate 213 is connected to the upper end of the outer peripheral wall 212. That is, the top plate 213 covers the upper side surface of the pump chamber 20.

As shown in FIGS. 3 and 4, the lower end of the outer peripheral wall 212 is in contact with the upper surface 24 of the second case body 22. The lower end of the outer peripheral wall 212 is in contact with the upper surface 24 of the second case body 22 over the entire circumference. Thereby, the pump chamber 20 is formed between the first case body 21 and the second case body 22.

As shown in FIG. 2, in the present embodiment, the first flange 211 and the second flange 221 are continuously formed over the entire circumference of the outer side surface 23 of the casing 2.

As shown in FIG. 3, the upper surface 24 of the second case body 22 is in contact with the rotor 3 and the vane 4. The rotor 3 has a substantially columnar shape. As shown in FIG. 2, the rotor 3 has a vane groove 31 in which the vane 4 is disposed. In the present embodiment, the vane groove 31 is formed at four places on the rotor 3. As shown in FIG. 3, the vane groove 31 is formed over the entire width of the rotor 3 in the Z direction.

The vane 4 has a plate shape. As shown in FIG. 2, the vane pump 1 of this embodiment has four vanes 4. The vane 4 is housed in the vane groove 31 formed in the rotor 3. As the rotor 3 rotates, the vane 4 projects in a direction away from the rotation axis of the rotor 3 due to centrifugal force. The vane 4 projects so as to slide on the inner side surface 214 of the outer peripheral wall 212 by the rotation of the rotor 3. The vane 4 rotates with the rotor 3 while sliding on the inner side surface 214 of the outer peripheral wall 212.

As shown in FIG. 4, the height "b" of the rotor 3, the height "c" of the vane 4, and the height "a" of the pump chamber 20 in the Z direction are measured at a reference temperature of the vane pump 1 (in this embodiment, the reference temperature is room temperature). More specifically, the height "a" of the pump chamber 20 is a dimension between the upper surface 24 of the second case body 22 and the lower surface 216 of the top plate 213 in the Z direction. The height "b" of the rotor 3 is a dimension between the upper surface 32 and the lower surface 33 of the rotor 3 in the Z direction. The height "c" of the vane 4 is a dimension between the upper surface 41 and the lower surface 42 of the vane 4 in the Z direction.

In the present embodiment, the rotor 3 and the vane 4 have substantially the same height in the Z direction. A clearance C1, which is the distance between the lower surface 216 of the top plate 213 and the upper surface 32 of the rotor 3 in the Z direction, is approximately the same as a clearance C2, which is the distance between the lower surface 216 of the top plate 213 and the upper surface 41 of the vane 4. In FIGS. 3 to 6, the clearance C1, C2, C10 is illustrated larger than actual for the sake of simplicity. The clearance C1, C2, C10 is, for example, 100 μm or less.

According to the first embodiment, the vane pump 1 satisfies at least one of Formula (1): $l \leq (b/a) \times k$ and Formula (2): $l \leq (c/a) \times j$. Therefore, when the temperature of the vane pump 1 rises, the clearance C1 between the casing 2 and the rotor 3 in the rotation axis direction Z of the rotor 3 can be suppressed from increasing, and the clearance C2 between the casing 2 and the vane 4 in the rotation axis direction Z of the rotor 3 can be suppressed from increasing. As a result, it is possible to restrict the discharge pressure from decreasing while the temperature rises.

The vane pump 1 changes in temperature due to various factors. In the present embodiment, the discharge pressure is suppressed from decreasing, while the temperature rises, by defining the linear expansion coefficients l, k, j and the dimensions a, b, c in the Z direction at the reference temperature, as described above.

In the present embodiment, the linear expansion coefficient k of the rotor 3 and the linear expansion coefficient j of the vane 4 are the same. The clearance C1 between the casing 2 and the rotor 3 and the clearance C2 between the casing 2 and the vane 4 are substantially the same. In order to simplify the description, the vane pump 1 will be described below when the temperature rises by taking the relationship between the casing 2 and the rotor 3 as an example.

Figure 5:
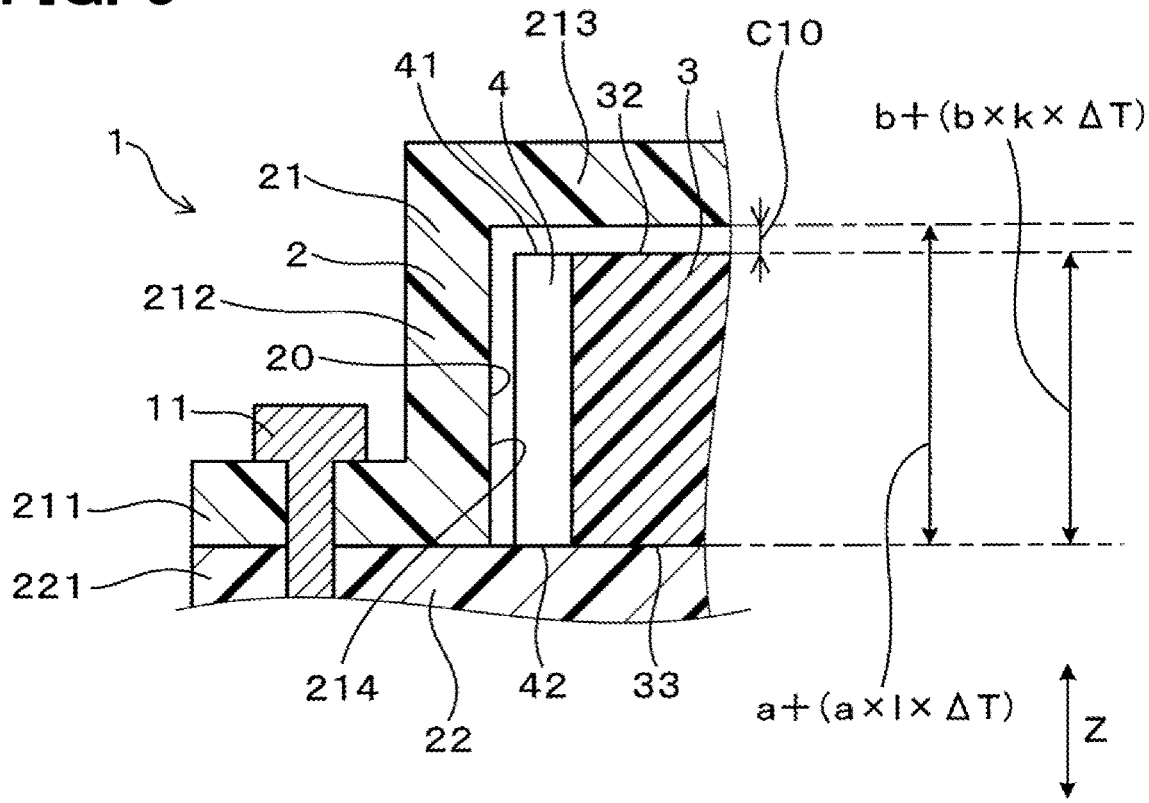
FIG. 5 is a cross-sectional view of the vane pump of the first embodiment when the temperature of the vane pump rises by ΔT.

When the temperature of the vane pump 1 rises due to the operation of the vane pump 1 or the like, the dimensions of the casing 2, the rotor 3, and the like that form the vane pump 1 may change according to their respective linear expansion coefficients. For example, when the temperature of the casing 2 forming the pump chamber 20 rises by ΔT from the reference temperature, the height of the pump chamber 20 increases by "a×l×ΔT". That is, as shown in FIG. 5, as the temperature rises, the height of the pump chamber 20 changes from "a" before the temperature rise to "a+(a×l×ΔT)". The height of the pump chamber 20 increases due to the expansion of the outer peripheral wall 212 in the Z direction as the temperature rises.

The height of the rotor 3 also increases by "b×k×ΔT" when the temperature rises by ΔT. That is, as shown in FIG. 5, as the temperature rises, the height of the rotor 3 changes from "b" before the temperature rise to "b+(b×k×ΔT)". The height of the rotor 3 increases as the rotor 3 itself expands in the Z direction.

When the temperature of the vane pump 1 rises by ΔT, the clearance C10 between the casing 2 and the rotor 3 can be calculated by subtracting the height "b+(b×k×ΔT)" of the rotor 3 from the height "a+(a×l×ΔT)" of the pump chamber 20. That is, the clearance C10 is defined by Formula (9).

$$C10 = a + a \times l \times \Delta T - (b + b \times k \times \Delta T) \quad \text{Formula (9)}$$

The linear expansion coefficient l of the casing 2 of the present embodiment satisfies Formula $l \leq (b/a) \times k$. Therefore, C10 satisfies the Formula (10) below. Then, Formula (10) is modified to Formula (11).

$$C10 \leq a + a \times (b/a) \times k \times \Delta T - (b + b \times k \times \Delta T) \quad \text{Formula (10)}$$

$$C10 \leq a - b \quad \text{Formula (11)}$$

That is, as shown in Formula (11), the clearance C10 between the casing 2 and the rotor 3 after the temperature of the vane pump 1 has risen by ΔT is smaller than or equal to the value calculated by subtracting the height "b" of the rotor 3 at the reference temperature from the height "a" of the pump chamber 20 at the reference temperature. In other words, the clearance C10 after the temperature rises by ΔT is equal to or smaller than the clearance C1 at the reference temperature. Therefore, when the temperature of the vane pump 1 rises, it is possible to restrict the clearance C1 between the casing 2 and the rotor 3 from increasing. Regarding the clearance C2 between the casing 2 and the vane 4, when the temperature rises, the clearance C2 can be suppressed from increasing for the same reason.

Figure 6:
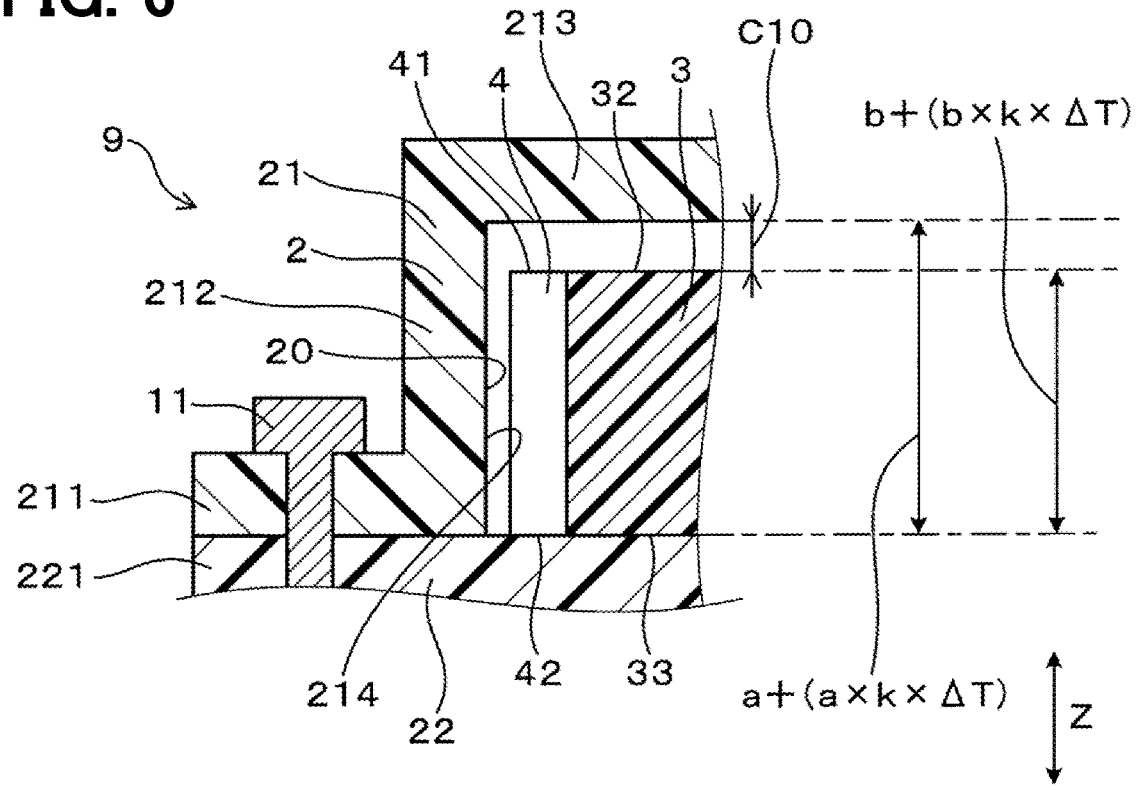
FIG. 6 is a cross-sectional view of a vane pump of a comparison example when the temperature of the vane pump rises by ΔT.

In case where the casing 2 and the rotor 3 have the same linear expansion coefficient, as the temperature rises, the dimension of the clearance C1 between the casing 2 and the rotor 3 increases. If the linear expansion coefficient l is equal to the linear expansion coefficient k, in a vane pump 9 of a comparison example shown in FIG. 6, when the temperature rises by ΔT, the clearance C10 is defined by Formula (14). As shown in FIG. 6, the clearance C10 is obtained by subtracting "b+(b×k×ΔT)", which is the height of the rotor 3, from "a+(a×k×ΔT)", which is the height of the pump chamber 20. Formula (14) is modified to Formula (15).

$$C10=a+a\times k\times\Delta T-(b+b\times k\times\Delta T) \quad \text{Formula (14)}$$

$$C10=(1+k\Delta T)\times(a-b) \quad \text{Formula (15)}$$

At the reference temperature, the clearance C1 is formed between the casing 2 and the rotor 3 in the Z direction. The value "a−b" (that is, the same value as the clearance C1 at the reference temperature) is larger than 0. Therefore, the clearance C10 calculated by Formula (15) increases in dimension as the temperature rises. Then, there is a possibility that the discharge pressure of the pump may decrease as the temperature rises.

According to the first embodiment, the vane pump 1 has a relationship of C10≤a−b as shown in Formula (11). Therefore, it is possible to restrict the clearance C1 from increasing when the temperature of the vane pump 1 rises. Also, for the same reason, it is possible to suppress the clearance C2 from increasing. As a result, it is possible to restrict the discharge pressure from decreasing while the temperature rises.

The vane pump 1 is controlled to rotate at a constant speed so that the rotation speed of the rotor 3 becomes constant. Therefore, fluctuations can be suppressed in pressure of fluid discharged from the pump. As a result, in the vane pump 1 that performs such control, the clearance C1, C2 can be suppressed from increasing while the temperature changes, so that the fluctuation in discharge pressure of the pump can be suppressed more effectively.

The vane pump 1 is controlled to rotate at a constant speed. Therefore, the rotation speed can be kept constant, for example, even if the frictional resistance between the vane 4, and the first case body 21 and the second case body 22 decreases, or if the frictional resistance between the rotor 3 and the second case body 22 decreases. Therefore, the vane pump 1 can be restricted from excessive heat generation caused by the increase in the rotation speed when the frictional resistance decreases. Therefore, the temperature rise of the vane pump 1 can be suppressed. As a result, fluctuations can be further suppressed in the discharge pressure of the pump.

When the vane pump 1 is used in the fuel processing device including the leak diagnosis unit, the discharge pressure of the pump, that is, the negative pressure value, is to be kept constant. If the discharge pressure of the pump fluctuates, it becomes difficult to perform a highly accurate leak diagnosis. Therefore, the constant rotation control as described above is performed. This makes it possible to maintain the discharge pressure of the pump constant and improve the accuracy of leak diagnosis. However, even if the rotation speed of the rotor 3 is kept constant, the discharge pressure of the pump is affected by the increase in the clearance C1, C2. Therefore, the discharge pressure of the pump can be kept more constant in the vane pump 1 that performs constant rotation control by adopting the configuration that suppresses increase in the clearance C1, C2 as in the present embodiment.

When the relationship of I=(b/a)×k is satisfied, even if the temperature of the vane pump 1 increases by ΔT, the clearance C1 at the reference temperature and the clearance C10 after the temperature rise are the same. That is, the clearance C1 between the casing 2 and the rotor 3 does not change while the temperature of the vane pump 1 rises. Further, for the same reason, the clearance C2 between the casing 2 and the vane 4 does not change. Therefore, the change in the discharge pressure of the vane pump 1 can be suppressed while the temperature rises.

According to the first embodiment, it is possible to provide the vane pump 1 that can suppress the decrease in the discharge pressure while the temperature rises.

Second Embodiment

In the second embodiment, the lower limit of the linear expansion coefficient l of the casing 2 is set. The vane pump 1 of this embodiment further satisfies at least one of Formulas (3) and (4).

$$l\geq 0.9\times(b/a)\times k \quad \text{Formula (3)}$$

$$l\geq 0.9\times(c/a)\times j \quad \text{Formula (4)}$$

In the present embodiment, both Formula (3) and Formula (4) are satisfied. That is, the linear expansion coefficient l of the casing 2 is 90% or more of the value that keeps the dimensions of the clearance C1 and the clearance C2 constant while the temperature rises.

In the present embodiment, when the temperature rises by ΔT, the clearance C10 satisfies Formula (12) based on Formulas (9) and (3). Further, Formula (13) is obtained by modifying Formula (12).

$$C10\geq a+a\times 0.9\times(b/a)\times k\times\Delta T-(b+b\times k\times\Delta T) \quad \text{Formula (12)}$$

$$C10\geq(a-b)-0.1\times b\times k\times\Delta T \quad \text{Formula (13)}$$

The others are the same as in the first embodiment. The reference numerals used in the second and subsequent embodiments which are the same reference numerals as those used in the above-described embodiment denote the same components as in the previous embodiments unless otherwise indicated.

In the second embodiment, the vane pump 1 satisfies the Formula: l≥0.9×(b/a)×k. Therefore, when the temperature of the vane pump 1 rises, it is possible to restrict the clearance C1 between the casing 2 and the rotor 3 from decreasing too much. As a result, it is possible to suppress the contact between the lower surface 216 of the top plate 213 of the casing 2 and the rotor 3 and suppress the change in the discharge pressure while the temperature rises. Further, it is easy to restrict so-called pump lock, which is an abnormal stop of the vane pump 1 due to the contact.

More specifically, as shown in Formula (13), the clearance C10 is larger than the value obtained by subtracting 10% of the height increase (=b×k×ΔT) of the rotor 3 when the temperature is increased by ΔT from the value of the clearance C1 at the reference temperature (=a−b). In other words, the decrease in the clearance C1 due to the temperature rise remains below 10% of the height increase of the rotor 3 when the temperature increases by ΔT. Therefore, it is possible to suppress the decrease in the clearance C1 while the temperature rises. Note that the clearance C2 can also be suppressed from decreasing while the temperature rises for the same reason. In the second embodiment, the same functions and advantages can be obtained as in the first embodiment.

Third Embodiment

Figure 7:
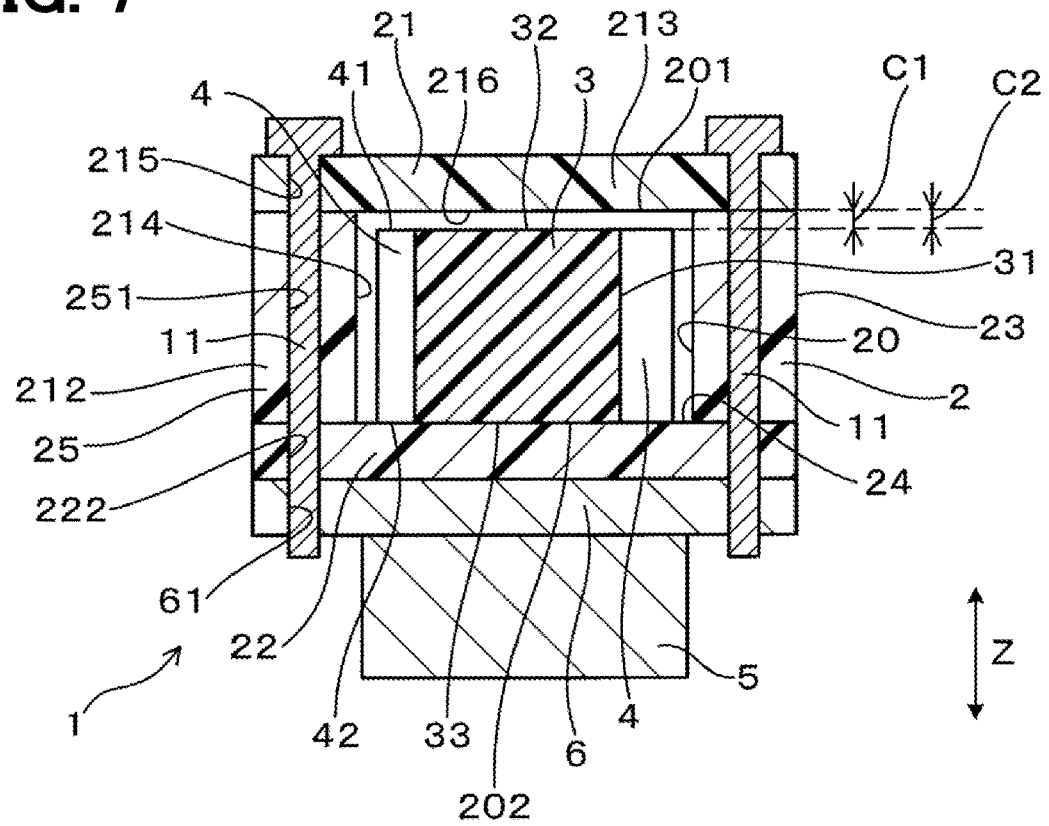
FIG. 7 is a cross-sectional view of a vane pump according to a third embodiment at a reference temperature.

In the present embodiment, as shown in FIG. 7, the fastening member 11 is arranged to extend across both end surfaces 201 and 202 of the pump chamber 20 in the Z direction.

In this embodiment, the casing 2 is composed of plural case bodies 21, 22, 25 arranged in the Z direction, as shown in FIG. 7. The case bodies 21, 22, and 25 are fastened and fixed by the fastening member 11 so as to come into pressure contact with each other in the Z direction. The fastening member 11 is arranged to extend in the Z direction between the end surfaces 201 and 202 of the pump chamber 20.

The linear expansion coefficient of the fastening member 11 is defined as "m" in the Z direction. In this case, at least one of Formulas (5) and (6) is satisfied.

$$m \leq (b/a) \times k, \quad \text{Formula (5)}$$

$$m \leq (c/a) \times j, \quad \text{Formula (6)}$$

The vane pump 1 of the present embodiment further satisfies at least one of Formulas (7) and (8).

$$m \geq 0.9 \times (b/a) \times k \quad \text{Formula (7)}$$

$$m \geq 0.9 \times (c/a) \times j \quad \text{Formula (8)}$$

In this embodiment, all of Formulas (5) to (8) are satisfied. Further, in the present embodiment, the linear expansion coefficient "m" of the fastening member 11 is smaller than the linear expansion coefficient "l" of the casing 2. The linear expansion coefficient "m" is a value larger than 0.

The first case body 21 of the casing 2 has a substantially circular flat plate shape. The first case body 21 constitutes a top plate 213 of the vane pump 1.

The second case body 22 has a substantially circular flat plate shape. The second case body 22 has substantially the same shape as the first case body 21.

The third case body 25 has a substantially cylindrical shape. The third case body 25 constitutes the outer peripheral wall 212 of the vane pump 1. The third case body 25 is arranged from the upper end surface 201 to the lower end surface 202 of the pump chamber 20 in the Z direction.

The third case body 25 is arranged between the first case body 21 and the second case body 22 in the Z direction. The upper end of the third case body 25 and the lower surface 216 of the first case body 21 are in contact with each other. Further, the lower end of the third case body 25 and the upper surface 24 of the second case body 22 are in contact with each other. The upper end of the third case body 25 is in contact with the lower surface 216 of the first case body 21 over the entire circumference. The lower end of the third case body 25 is in contact with the upper surface 24 of the second case body 22 over the entire circumference. The first case body 21 and the second case body 22 are arranged so as to cover the openings of the third case body 25 that are open on the both sides in the Z direction.

In the present embodiment, the first case body 21, the second case body 22, and the third case body 25 are separate bodies, but the first case body 21 and the third case body 25 may be integrally formed. Further, the second case body 22 and the third case body 25 may be integrally formed.

The first case body 21, the second case body 22, and the third case body 25 are fastened and fixed by the fastening member 11 so as to be in pressure contact with each other in the Z direction, and are fixed to the fixed member 6. As shown in FIG. 7, the fastening member 11 is inserted into the insertion hole 215 formed on the outer peripheral side of the first case body 21, the insertion hole 251 formed on the outer peripheral side of the third case body 25, and the insertion hole 222 formed on the outer peripheral side of the second case body 22. The fastening member 11 is engaged with the female thread 61 of the fixed member 6. Further, the fastening member 11 is disposed so as to extend from the upper end to the lower end of the third case body 25. The others are the same as in the first embodiment.

In the present embodiment, the linear expansion coefficient "k" of the rotor 3 and the linear expansion coefficient "j" of the vane 4 are the same. The clearance C1 between the casing 2 and the rotor 3 and the clearance C2 between the casing 2 and the vanes 4 are substantially the same. In order to simplify the description, the function and effect of this embodiment will be described below by taking the relationship between the casing 2 and the rotor 3 as an example.

The vane pump 1 of this embodiment satisfies Formula: $m \leq (b/a) \times k$. Therefore, when the temperature of the vane pump 1 rises, it is possible to restrict the clearance C1 between the casing 2 and the rotor 3 in the Z direction from increasing. As a result, it is possible to restrict the discharge pressure from decreasing while the temperature rises.

In this embodiment, the amount of change in the clearance C1 between the casing 2 and the rotor 3 is determined not by the linear expansion coefficient "l" of the casing 2 but by the linear expansion coefficient "m" of the fastening member 11. As shown in FIG. 7, the height of the third case body 25 in the Z direction is the height "a" of the pump chamber. Further, the case bodies 21, 22, 25 forming the casing 2 are fastened and fixed by the fastening member 11 so as to come into pressure contact with each other in the Z direction. Therefore, even if the temperature of the vane pump 1 rises, the fastening member 11 suppresses increase in the dimension of the third case body 25 in the Z direction.

As the temperature of the vane pump 1 rises, the dimension of the fastening member 11 in the Z direction increases, so that the height "a" of the pump chamber 20 increases. The height "a" of the pump chamber 20 is increased by increasing the dimension of a portion of the fastening member 11 located between the both end surfaces 201 and 202 of the pump chamber 20 in the Z direction. In other words, the height "a" of the pump chamber 20 increases because the dimension of a portion of the fastening member 11 that is inserted and arranged in the insertion hole 251 of the third case body 25 is increased. Therefore, it is possible to restrict the clearance C1 from increasing by satisfying Formula: $m \leq (b/a) \times k$, when the temperature of the vane pump 1 rises.

Further, the vane pump 1 of the present embodiment also satisfies Formula: $m \geq 0.9 \times (b/a) \times k$ as described above. Therefore, when the temperature of the vane pump 1 rises, it is possible to restrict the clearance C1 from decreasing too much. As a result, the contact between the lower surface 216 of the first case body 21 and the rotor 3 can be suppressed, and the change in the discharge pressure can be suppressed while the temperature rises.

The clearance C2 between the casing 2 and the vane 4 is also suppressed from increasing while the temperature rises and is restricted from decreasing too much for the above-mentioned reason. In the third embodiment, the same functions and advantages are obtained as in the first embodiment.

The present disclosure is not limited to the embodiments described above, and various modifications may be adopted within the scope of the present disclosure without departing from the spirit of the disclosure.

What is claimed is:

1. A vane pump comprising:

a casing forming a pump chamber therein;

a rotor arranged inside the casing to rotate eccentrically with respect to the casing; and a plurality of vanes configured to rotate with the rotor and slide on an inner side surface of the casing, wherein at least one of Formulas (1) and (2) is satisfied, $$l \leq (b/a) \times k, \text{ and} \quad \text{Formula (1)}$$

$$l \leq (c/a) \times j, \quad \text{Formula (2)}$$

wherein "a" represents a height of the pump chamber in a rotation axis direction of the rotor, wherein "b" represents a height of the rotor in the rotation axis direction, wherein "c" represents a height of the vane in the rotation axis direction, wherein "l" represents a linear expansion coefficient of the casing in the rotation axis direction, wherein "k" represents a linear expansion coefficient of the rotor in the rotation axis direction, and wherein "j" represents a linear expansion coefficient of the vane in the rotation axis direction.

2. The vane pump according to claim 1, further satisfying at least one of Formulas (3) and (4), $$l \geq 0.9 \times (b/a) \times k, \text{ and} \quad \text{Formula (3)}$$

$$l \geq 0.9 \times (c/a) \times j. \quad \text{Formula (4)}$$

3. The vane pump according to claim 1, wherein the rotor is controlled so that a rotation speed of the rotor is constant.

4. A vane pump comprising:

a casing forming a pump chamber therein;

a rotor arranged inside the casing to rotate eccentrically with respect to the casing; and a plurality of vanes configured to rotate with the rotor and slide on an inner side surface of the casing, wherein the casing is formed of a plurality of case bodies arranged in a rotation axis direction of the rotor, the plurality of case bodies are fastened and fixed by a fastening member so as to be in a pressure contact with each other in the rotation axis direction, the fastening member is arranged to extend in the rotation axis direction between both end surfaces of the pump chamber in the rotation axis direction, at least one of Formulas (5) and (6) is satisfied, $$m \leq (b/a) \times k, \text{ and} \quad \text{Formula (5)}$$

$$m \leq (c/a) \times j, \quad \text{Formula (6)}$$

wherein "a" represents a height of the pump chamber in the rotation axis direction, wherein "b" represents a height of the rotor in the rotation axis direction, wherein "c" represents a height of the vane in the rotation axis direction, wherein "m" represents a linear expansion coefficient of the fastening member in the rotation axis direction, wherein "k" represents a linear expansion coefficient of the rotor in the rotation axis direction, and wherein "j" represents a linear expansion coefficient of the vane in the rotation axis direction.

5. The vane pump according to claim 4, further satisfying at least one of Formulas (7) and (8), $$m \geq 0.9 \times (b/a) \times k, \text{ and} \quad \text{Formula (7)}$$

$$m \geq 0.9 \times (c/a) \times j. \quad \text{Formula (8)}$$

* * * * *